US006658726B1

(12) United States Patent
Conte

(10) Patent No.: US 6,658,726 B1
(45) Date of Patent: Dec. 9, 2003

(54) CABLE DEPOSIT DEVICE

(75) Inventor: Alois Conte, Ebikon (CH)

(73) Assignee: Komax Holding AG, Dierikon (CH)

( * ) Notice: Subject to any disclaimer, the term of this patent is extended or adjusted under 35 U.S.C. 154(b) by 209 days.

(21) Appl. No.: 09/642,274

(22) Filed: Aug. 18, 2000

(30) Foreign Application Priority Data

Aug. 21, 1999 (CH) ..... 19991537/99

(51) Int. Cl.[7] ..... H01R 43/052

(52) U.S. Cl. ..... 29/753; 29/33 M; 29/747; 29/748; 29/749; 29/755; 29/863

(58) Field of Search ..... 29/753, 755, 33 M, 29/33 F, 747, 748, 749, 861, 863, 865, 866, 867

(56) References Cited

U.S. PATENT DOCUMENTS 4,615,100 A * 10/1986 Reinertz
5,063,656 A 11/1991 Hirano et al.
5,305,508 A * 4/1994 Koch et al.
5,740,608 A 4/1998 Long
5,960,622 A * 10/1999 Koch et al.
6,357,575 B1 * 3/2002 Conte
2001/0047589 A1 * 12/2001 Conte

FOREIGN PATENT DOCUMENTS

CH 0 788 200 A2 6/1997

* cited by examiner

*Primary Examiner*—Gregory Vidovich
*Assistant Examiner*—Eric Compton
(74) *Attorney, Agent, or Firm*—Blakely, Sokoloff, Taylor & Zafman LLP

(57) ABSTRACT

A swing-down separating means (24) connected to the pivot arm (21) is provided for the initial separation of the two cables (3,4) of a double crimped cable (25). This separating means may be moved such that it is in detachable engagement with a guide and separating part (28) arranged in a first cable deposit trough (26) which may be emptied as a result of a lateral pivotal movement. To transfer the double crimped cables (25) in the separated condition in the emptying position of the first cable deposit trough (26), this first cable guide and separating part (28) may in turn be moved such that it is in detachable engagement with a second cable guide and separating part (29) arranged in a second cable deposit trough (27), which is located below the first cable deposit trough (26) and may be moved laterally in the longitudinal direction.

10 Claims, 6 Drawing Sheets

A - A

B - B

CABLE DEPOSIT DEVICE

BACKGROUND

The invention relates to a cable deposit device for automatic cable processing units.

The manufacture of double crimped cables by means of automatic cable processing units is known, in which two cables having possibly different cross-sections and different lengths are mutually connected at their one-end by means of a single crimp contact and were likewise each provided with a crimp contact at their other ends. Here, there is a risk of the two cable portions which are mutually connected in this manner becoming tangled with one another, and, after their manufacture, necessitates immediate removal and spatial separation of the two free cable portions by hand, as well as an appropriate deposit area.

The object of the present invention is to provide a cable deposit device of the type mentioned at the outset, which does not have the above-described disadvantages of the previous devices, that is to say by means of which two cable which are processed parallel to one another are deposited in a cable deposit trough such that, even when they are mutually connected at one end by way of a double crimp contact, they are spaced apart from one another at least over part of their length so that they may be separated.

BRIEF DESCRIPTION OF THE DRAWINGS

The invention is explained in more detail below by way of example, with reference to the drawing, in which.

DETAILED DESCRIPTION

The invention relates to a cable deposit device for automatic cable processing units for depositing two cables on at least one cable receiving surface, said cables being connected at their one end to form a double cable, cut to size and stretched out, and for separating these cables after they have been processed, a cable receiving region being formed in the region, of the ejection axes of cables conveyed out of the automatic cable processing unit, and a pivot arm having at least one cable gripping unit being provided in the cable entry region of said cable receiving region, said pivot arm serving to grip the rear ends—as seen in their transport direction—of the two cables and to supply the rear ends to be processed of the two cables to at least one cable processing station located in the pivot region of the pivot arm, the pivot region of he pivot arm extending. beyond :both ejection axes, and the last cable processing station in the cable processing procedure being constructed as a double crimping unit.

In the exemplary embodiment described, below, the cable receiving surface is formed by an upper carrying side of a continuously revolving receiving conveyor-belt 14 to form a region 15 for receiving and stretching out the cables. However, for shorter cables 3, 4, a stationary cable receiving surface would suffice.

Figure 1:
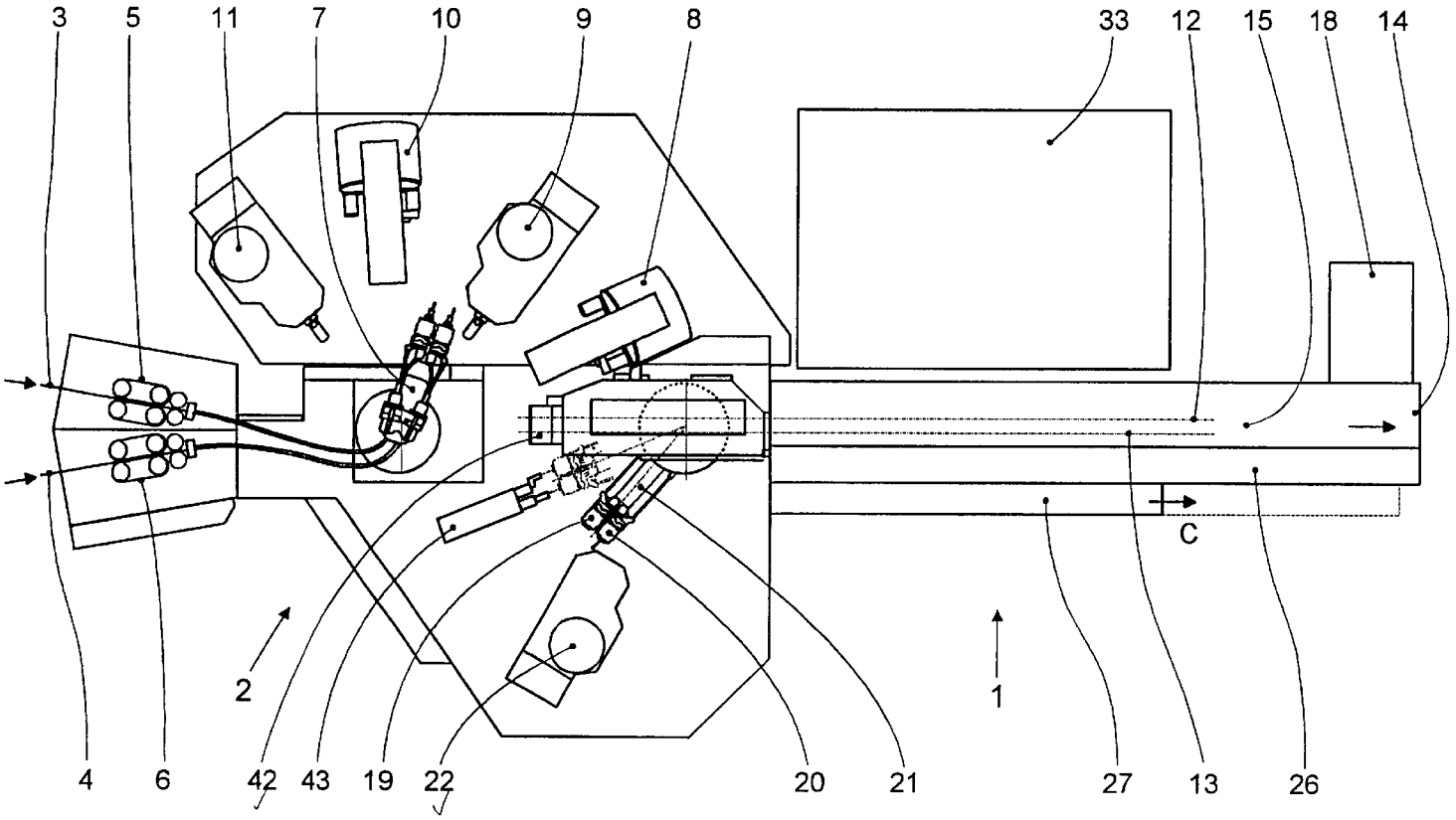
FIG. 1 shows a schematic sketch of an exemplary embodiment of a cable deposit device according to the invention combined with a previously known automatic cable processing unit.

As can be seen in particular in FIG. 1, the cable deposit device 1 is connected to a conventional, previously known automatic cable processing unit 2 to form a common operating unit, and functions such that cables 3 and 4, which have been processed by the automatic cable processing unit 2, may be deposited separately for the manufacture of so-called double crimped cables 25 or for example two single conductors having different diameters.

By means of the two belt drive units 5 and 6, the two cables 3 and 4 are supplied in known manner to a pivot head 7 which supplies the leading ends of the cables 3 and 4 to one or more of the processing stations 8 to 11 for the purpose of stripping them and then pressing a crimp contact thereon.

After the leading ends of the two cables 3 and 4 have been processed, they are ejected at high speed along the two ejection axes 12 and 13 into the cable deposit device 1.

In the region of the two ejection axes 12, 13 of the two cables 3,4 conveyed out of the automatic cable processing unit 2, a region 15 for receiving and stretching out the cables is formed by an upper carrying side of a continuously revolving receiving conveyor belt 14. Here, the receiving conveyor belt 14 is guided by way of the two idler pulleys 16 and 17 (FIG. 2), and is driven by means of a drive motor 18 connected to the idler pulley 17, such that the rotational speed of the receiving conveyor belt 14 is greater than the ejection speed of the two cables 3 and 4 conveyed out of the automatic cable processing unit 2, in order that the two cables are received stretched out on the region 15 for receiving and stretching out the cables.

A pivot arm 21 having two cable gripping units 19 and 20 is provided in the cable entry region of the receiving conveyor belt 14, said pivot arm being intended for gripping the rear ends-as seen in their transport direction-of the two cables 3 and 4 and for supplying the rear ends of the two cables 3 and 4 to a stripping unit 42 located in the pivot region of the pivot arm 21, then to a unit 43 for bringing the cable ends together, and then to a double crimping unit 22. Here, the unit 43 for bringing the cable ends together may be constructed in the manner described in the unpublished European patent application 98 810 861.9. In the unit 43 for bringing the cable ends together, the previously stripped rear ends of the two cables 3 and 4 are placed together and then mutually connected in a double crimping unit 22 by means of a common crimp contact.

Here, the pivot arm 21 provided with two cable gripping units 19 and 20 may be part of the automatic cable processing unit 2 or part of the cable deposit device 1.

Figure 8:
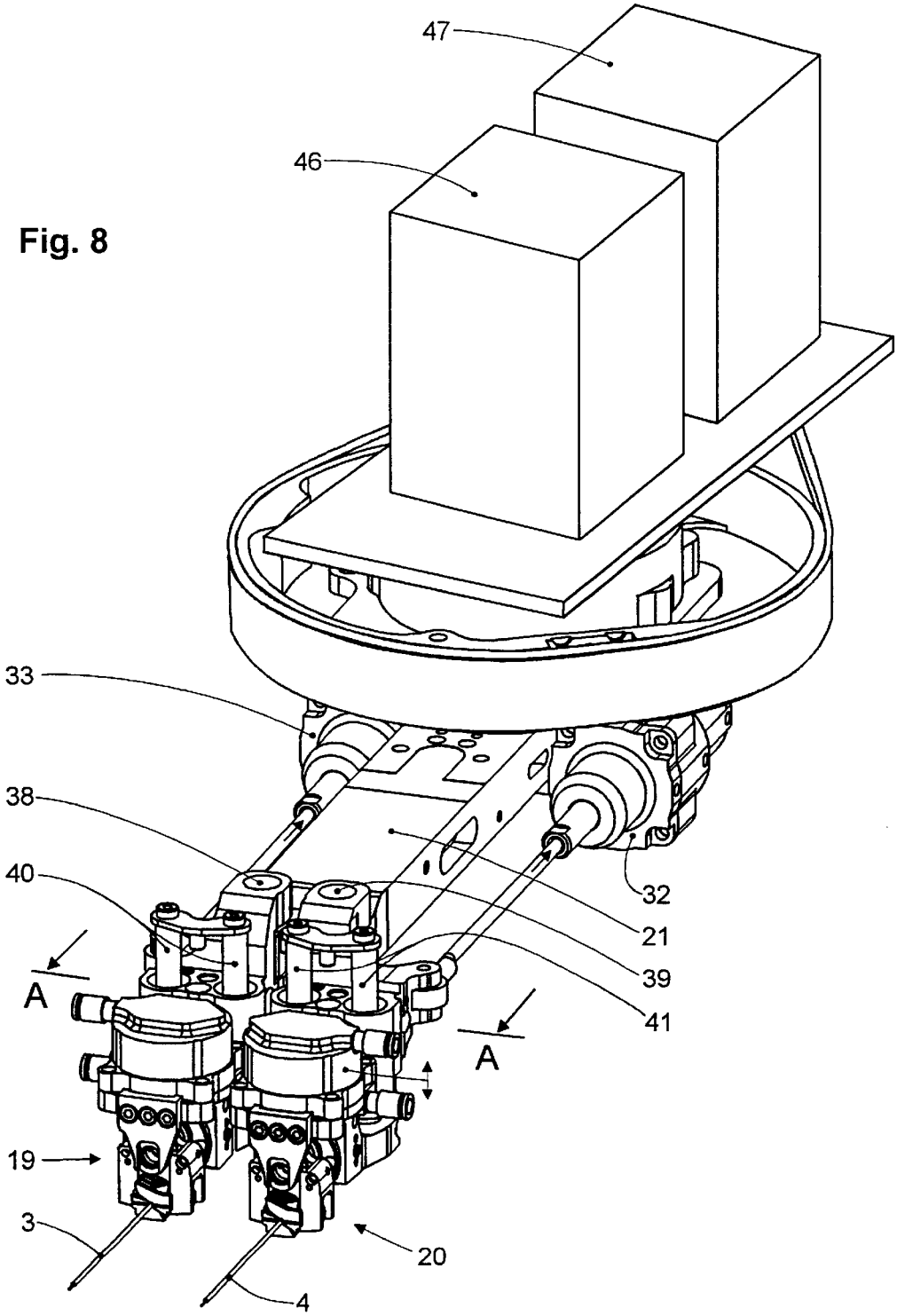
FIG. 8 shows, on an enlarged scale, a perspective view of the two cable gripping units mounted next to one another on a pivot arm according to FIG. 1.

Here, in known manner, a first motor drive 47 serves to pivot the pivot arm 21 in precisely controlled manner, and a second motor drive 46 serves to displace the latter in the longitudinal direction (FIG. 8).

As can be seen in FIGS. 2 to 7, in that pivoted position of the pivot arm 21 (illustrated by dashed lines in FIG. 1) which is. associated with the unit 43 for bringing the cable ends together, provided below the two cable gripping units 19 and 20 connected to the pivot arm there is both a cable supporting arrangement which is provided with a pivotal cable supporting bracket 23 and which, in this displaced, pivoted position of the pivot arm 21, lifts the two rear ends, which have been brought together by the unit 43 for bringing the cable ends together, of the two cables 3 and 4 into the grasping region of the cable gripping unit 20 (FIG. 3), and releases them after they have been gripped by the latter (FIG. 4), as well as a swing-down separating means 24 which is connected to the pivot arm 21 by way of the cable gripping unit 20 and which, before the two cables 3 and 4 which are to be mutually connected are brought together by the unit 43 for bringing the two cables together, may be pivoted down in the vertical direction between the two latter.

After the double crimped cable 25 has been completed, this swing-down separating means 24 is left in the vertically downward pivoted separating position (FIG. 4) for the purpose of further separating the two cables 3 and 4 of said double crimped cable which are mutually crimped together, and, by pivoting the pivot arm 21 back in corresponding manner, is moved into a pivoted position of the latter in which the swing-down separating means 24 is located precisely above a first upwardly extending cable guide and separating part 28, which is arranged in a first cable deposit trough 26 located below said swing-down separating means. In this pivoted position of the pivot arm 21, by drawing out the cable guide and separating part 28, the swing-down separating means 24 may be moved such that it is in detachable engagement with the first cable guide and separating part 28 extending from a first cable deposit trough 26 which, in this pivoted position of the pivot arm 21, is located below the two cable gripping units connected to the pivot arm 21, extends parallel to the longitudinal direction of the receiving conveyor belt 14 and may be emptied perpendicular to this longitudinal direction into a second cable deposit trough 27 as a result of a lateral pivotal movement, which second cable deposit trough may be moved below said first cable deposit trough in the longitudinal direction C thereof.

For the purpose of retaining the separated condition of the two cables 3 and 4 of a double crimped cable 25 during its transfer from the first cable deposit trough 26 into the second cable deposit trough 27, in the emptying position of the first cable deposit trough 26 (FIG. 7) this first cable guide and separating part 28, which may be pivoted together with the first cable deposit trough 26, may be moved such that it is in detachable engagement with a second double-crimped cable guide and separating part 29 arranged in the second cable deposit trough 27.

Figure 5:
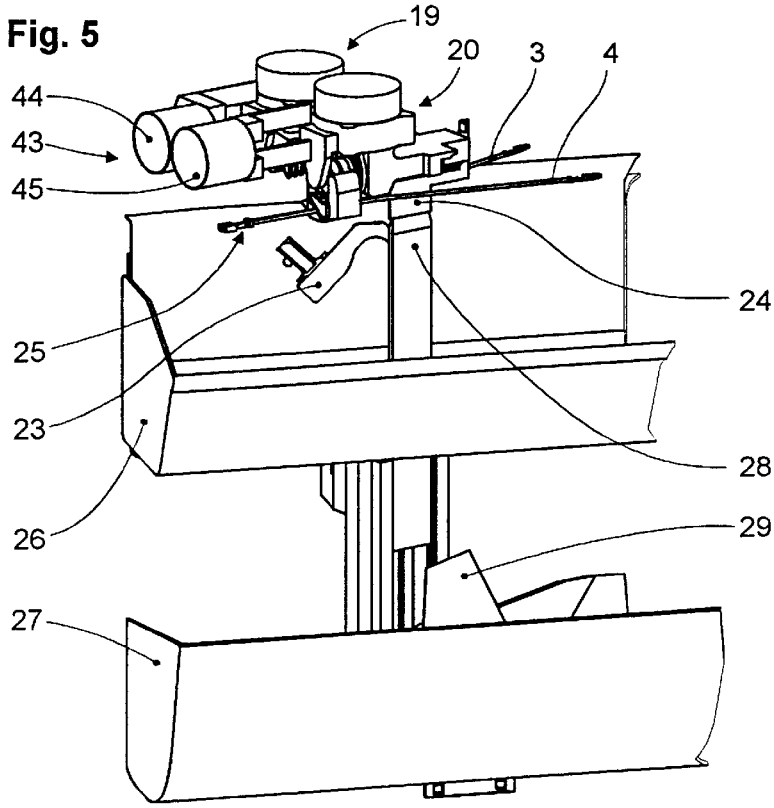

When using thin, very flexible cables 3 and 4, it is possible that these may hang down slightly when the pivot arm 21 is pivoted out of a starting position extending parallel to the receiving conveyor belt 14. If this occurs, in order to reliably prevent these cables 3, 4 from possibly catching on the first cable guide and separating part 28, the latter may be displaced in its longitudinal direction, that is to say, when the pivot arm 21 pivots, it may be drawn back into the position illustrated in FIG. 2 and drawn out later such that it is in engagement with the swing-down separating means 24 (FIG. 5).

In order to ensure that the double crimped cable 25 located in the first cable deposit trough 26 is transferred—in problem free manner into the second cable deposit trough 27, even when the pivoting angles of the first cable deposit trough 26 into the emptying position (FIG. 7) thereof are relatively small, a cable pushing means 30 is associated with the first cable guide and separating part 28 and may be displaced in its longitudinal direction along the latter.

In order to move the rear end—as seen in the movement direction—of the two cables 3, 4 to be connected to form a double crimped cable 25 in and out of engagement with the cable processing stations 42, 43, and 22, the two cable gripping units 19 and 20 mounted on the pivot arm 21 may be displaced in precise manner, controlled by way of the control unit 33 (FIG. 1), with the aid of a motor drive 46 displacing the pivot arm 21 in its longitudinal direction.

Furthermore, the two cable gripping units 19 and 20 are mounted on the pivot arm 21 such that they are each pivotal in a horizontal plane about a respective vertical axis 38 and 39 and may be pivoted towards and away from the in each case other cable gripping unit by way of two pneumatic cylinder units, 32 and 33 respectively, each having three operating positions, so that for example, when crimping the rear guided together ends of the cables 3 and 4 in the double crimping unit 22, the cable gripping unit 19 may be pivoted away laterally with the aid of the pneumatic cylinder unit 33 so that the rear ends of the cables 3 and 4 are more accessible.

In addition, thanks to the two vertical guide means 40 and 41, the two cable gripping units 19 and 20 may be lowered resiliently downwards in opposition to the action of at least one upwardly acting pressure spring (not illustrated). This is particularly important when crimping takes place in the double crimping unit 22, since, when crimping is effected, by means of a pressure die, the respective cable ends of the two cables 3 and 4 are thus lowered a little and, during this, the associated cable gripping unit 20 is lowered the same distance downwards in opposition to the spring action by way of the pressure die.

Figure 2:
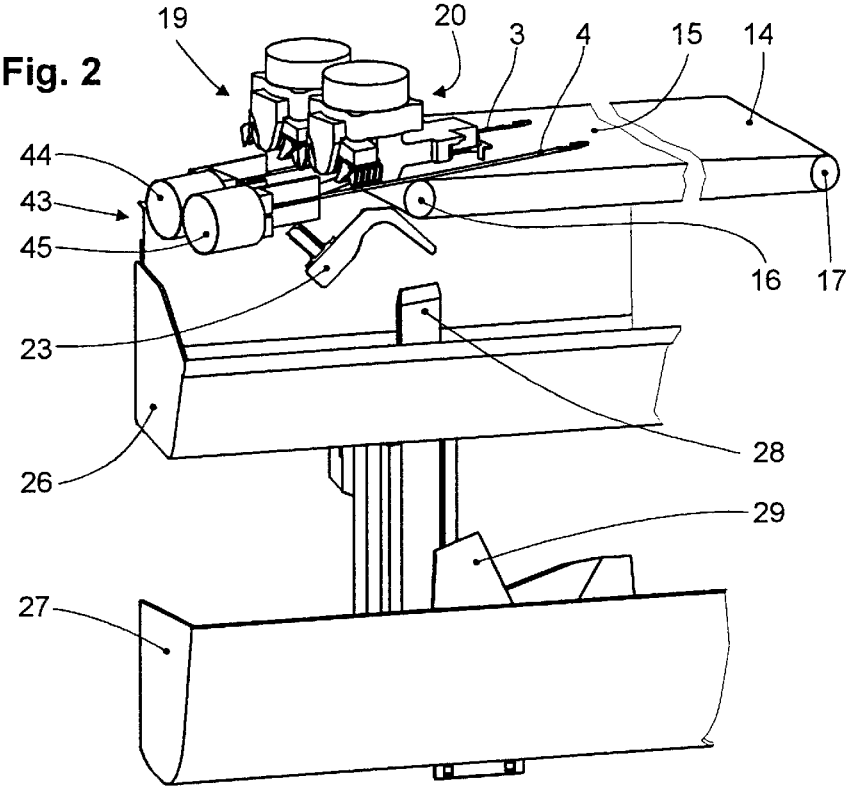
FIG. 2 shows a perspective view of part of the cable deposit device illustrated in the sketch of FIG. 1.
Figure 3:
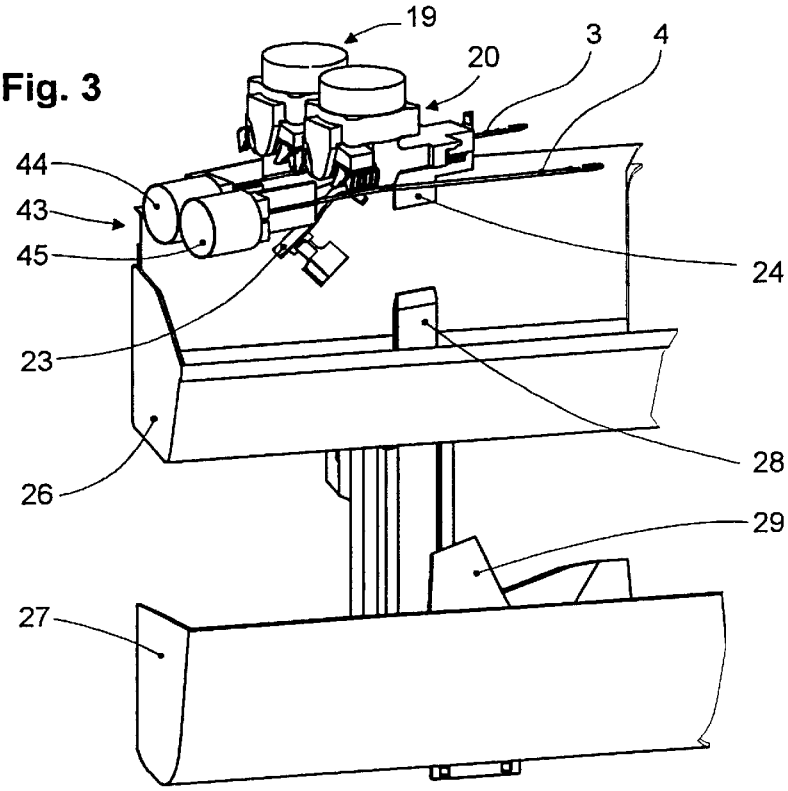
FIGS. 3 to 5 shows perspective views analogous to FIG. 2, but illustrated in each case after a further operating step and without the receiving conveyor belt for the sake of clarity.
Figure 4:
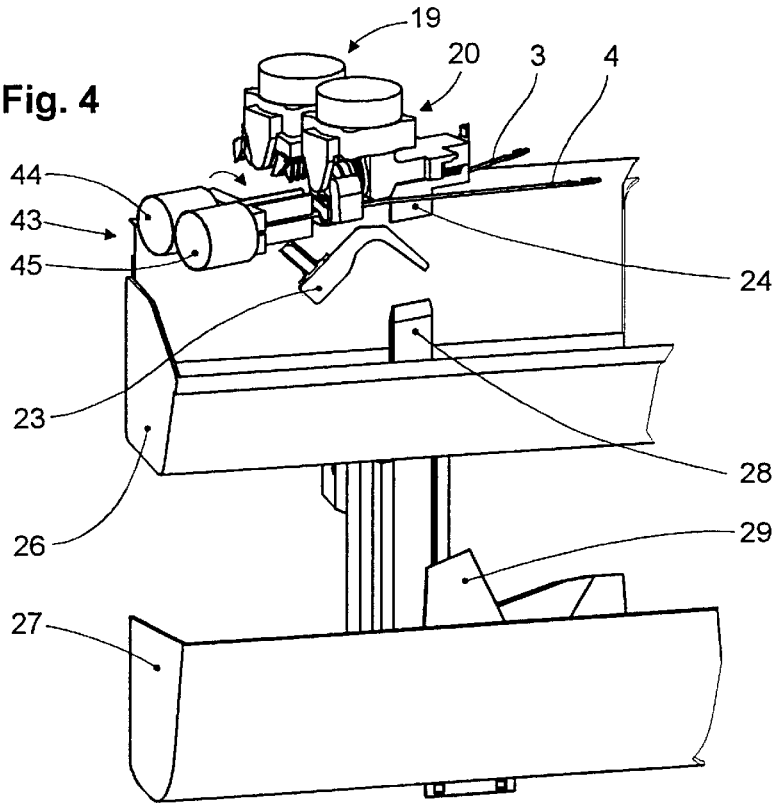

As already mentioned, the unit 43 for bringing the cable ends together is constructed in the manner described for example in European patent application 98 810 861.9, that is to say, as can be seen in particular in FIGS. 2 and 3, those two stripped ends of the two cables 3 and 4 which are to be crimped together are supplied to a respective gripper unit 44 and 45 of the unit 43 for bringing the cable ends together, then, after the two cables 3 and 4 have been released, these two ends are brought together by the two cable gripping units 19 and 20 as a result of a rotational movement on behalf of the gripper associated with the gripper unit 44 (FIG. 4), the two cables 3 and 4 are held together by the cable gripping unit 20, and then, after further displacement of the pivot arm 21 as far as the double crimping unit 22, these two ends which are brought together in this manner are mutually connected in the double crimping unit by way of a single crimp contact.

Figure 6:
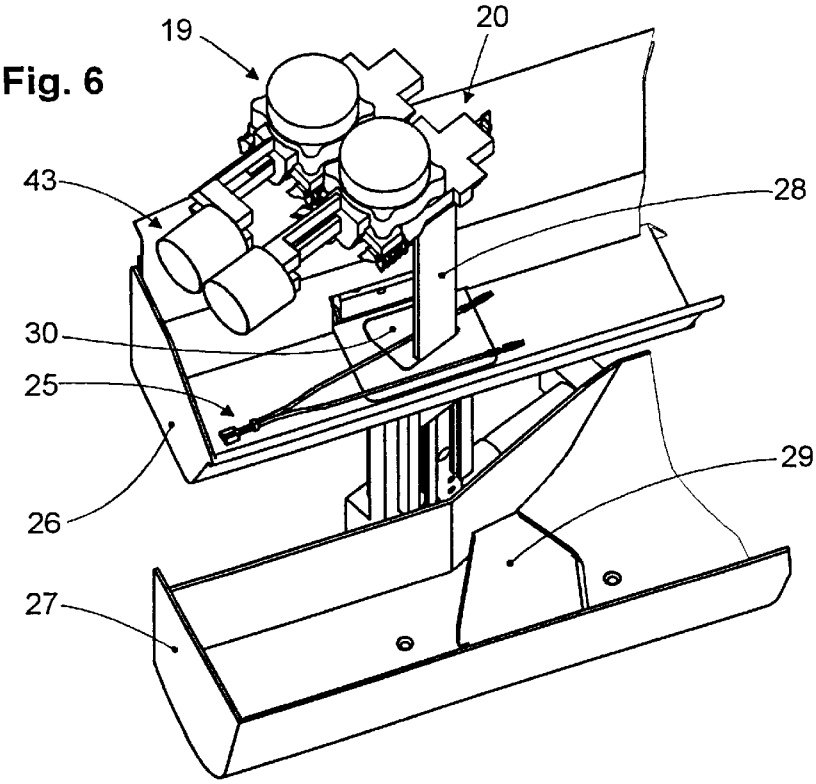
FIG. 6 shows a perspective view similar to FIG. 3, but from a different viewing angle, with the double crimped cable deposited in the first cable deposit trough.
Figure 7:
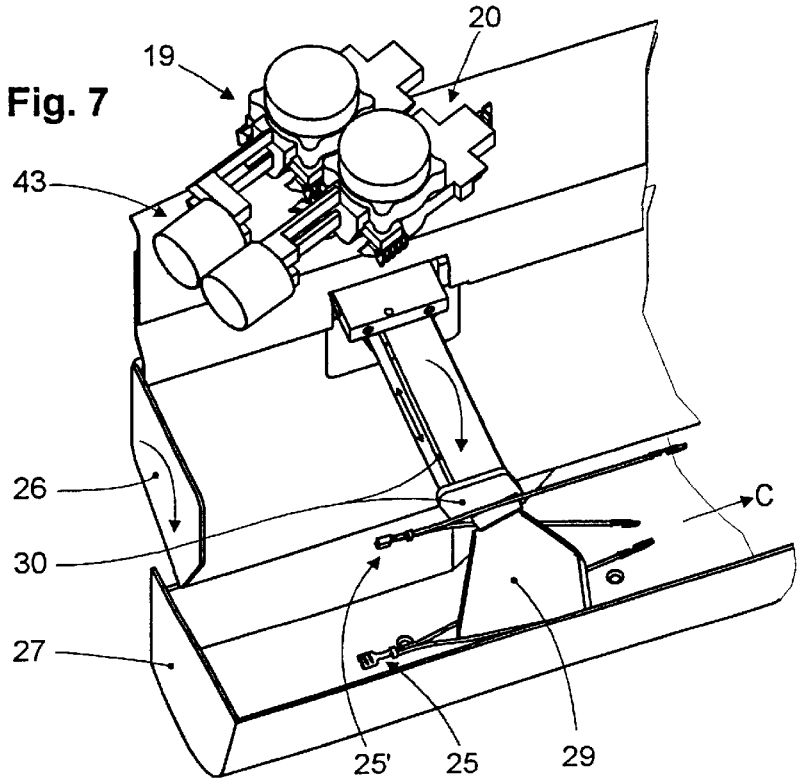
FIG. 7 shows a perspective view analogous to FIG. 6, but as a double crimped cable is transferred from the first, laterally pivotal cable deposit trough into the second cable deposit trough, which may be drawn out in its longitudinal direction.

Then, the pivot arm 21 is pivoted back again, that is to say it is moved into the cable ejection position illustrated in FIG. 5, in which the first cable guide and separating part 28 is moved such that it is in engagement with the swing-down separating means 24, and then the gripper of the cable gripping unit 20 is released so that, as can be seen in FIG. 6, the double crimped cable 25 drops down into the first cable deposit trough 26 with the cables 3 and 4 separated by the first cable guide and separating part 28.

Figure 9:
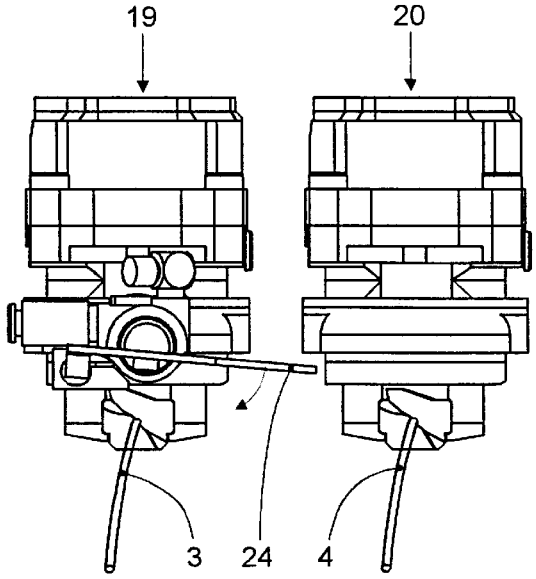
FIG. 9 shows a section along the line A—A in FIG. 8.
Figure 11:
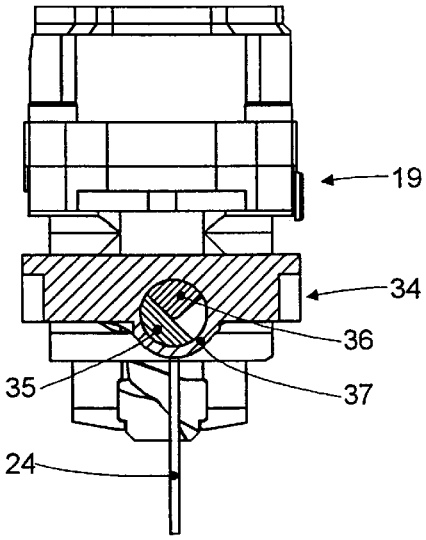
FIG. 11 shows a section along the line B—B in FIG. 10.
Figure 10:
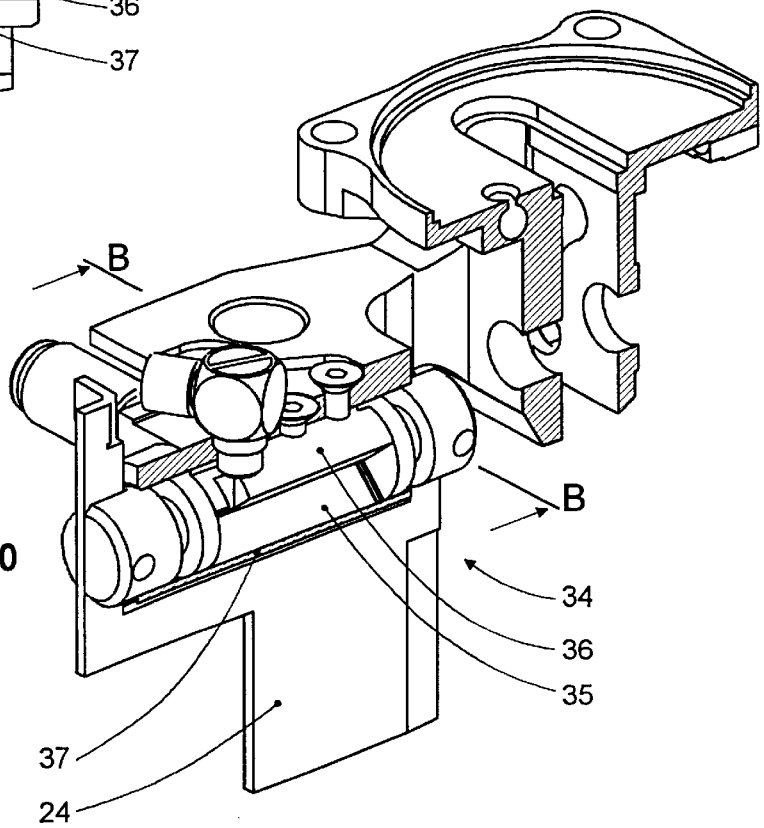
FIG. 10 shows a perspective view, illustrated in a partial section, of the drive of the swing-down separating unit associated with the cable gripping unit in FIG. 9.

The arrangement and the pivot drive of the swing-down separating means 24 can be seen in particular on an enlarged scale in FIGS. 9, 10 and 11.

As can be seen in these Figures, the pivotal swing-down cable separating means 24 and its drive 34 are flanged to the cable gripping unit 20. To pivot the swing-down separating means 24, the pneumatic drive 34 is provided with a rotary piston 35 which, as can be seen in particular in FIG. 11, may be moved pneumatically through approximately 90° between the lateral stop faces of a fixedly arranged stop element 36 within a cylinder 37

It is of course also possible to provide only one cable gripping unit 20 and to supply the two cables 3 and 4 to the unit 43 for bringing the cable ends together in two steps.

When this cable deposit device 1 is in operation, a particular batch size of completed double crimped cables 25 is first stored temporarily in the first cable deposit trough 26 and, after this batch size has been reached, is transferred into the second cable deposit trough 27 whilst retaining the separated condition of the cables 3 and 4, said cable deposit trough then being displaced in its longitudinal direction C, thereby moving the completed double crimped cables 25 so that they may be separated and removed by hand from the danger zone of the automatic cable processing unit 2.

After the first deposit trough 26 has been emptied, it may be moved immediately back into its receiving position again, so that the double crimped cables 25 may be manufactured continuously, and there is still sufficient time remaining for the completed batches of double crimped cables 25 to be removed by hand from the second cable deposit trough 27 in risk-free manner.

What is claimed is:

1. A cable deposit device comprising:

a pivot arm having a cable gripping unit located in a cable entry region of a cable receiving region, said cable receiving region being in a region of an ejection axis of a pair of cables to be conveyed;

a plurality of cable processing stations located in a pivot region of the pivot arm, the pivot region extends beyond the ejection axis;

first means for separating the pair of cables;

second means for separating the pair of cables, said first separation means being moveable to detachably engage said second separation means and guide the pair of cables into a first cable deposit trough on the same side of a vertical plane that runs through the cable ejection axis; and third means for separating the pair of cables, said second separation means being moveable to detachably engage said third separation means and guide the pair of cables into a second cable deposit trough.

2. A cable deposit device as in claim 1, further comprising:

a continuously revolvable conveyor belt to receive and stretch out the pair of cables; and wherein the first cable deposit trough extends approximately parallel to a longitudinal axis of the conveyor belt and can be pivoted laterally in a direction perpendicular to the longitudinal axis to empty its contents.

3. A cable deposit device as in claim 1 wherein the second separation means can pivot about a pivot axis that is parallel to a longitudinal axis of the first cable deposit trough.

4. A cable deposit device as in claim 1 wherein the second separation means is moveable in its longitudinal direction.

5. A cable deposit device as in claim 1 further comprising:

means for pushing cables that are separated by the second separation means, the pushing means being moveable in its longitudinal direction along the second separation means.

6. A cable deposit device as in claim 1 wherein, next to said cable gripping unit, the pivot arm has another cable gripping unit.

7. A cable deposit device as in claim 1 wherein the cable gripping unit is connected to the pivot arm so that it may be displaced in a longitudinal direction of the pair of cables.

8. A cable deposit device as in claim 1 wherein the cable gripping unit is height-adjustable in a vertical direction with respect to the pivot arm.

9. A cable deposit device as in claim 6 wherein the pair of cable gripping units are arranged on the pivot arm so that they can be pivoted independently laterally from one another.

10. A cable deposit device as in claim 1 wherein the stations include means for bringing ends of the pair of cables together and means for crimping the pair of cables together.

* * * * *